US005779100A

United States Patent [19]

Johnson

[11] Patent Number: 5,779,100

[45] Date of Patent: Jul. 14, 1998

[54] VACUUM ACTUATED REPLENISHING WATER GUN

[75] Inventor: Lonnie G. Johnson, Smyrna, Ga.

[73] Assignee: Johnson Research & Development Corp, Inc., Atlanta, Ga.

[21] Appl. No.: 693,407

[22] Filed: Aug. 7, 1996

[51] Int. Cl.[6] ..... A63H 33/00

[52] U.S. Cl. ..... 222/79; 222/380

[58] Field of Search ..... 222/79, 372, 380, 222/383.1, 385, 400.8, 401

[56] References Cited

U.S. PATENT DOCUMENTS

| | | | |
|---|---|---|---|
| D. 78,206 | 4/1929 | Hermann . | |
| D. 159,040 | 6/1950 | Bicos | D30/1 |
| D. 265,221 | 6/1982 | Hardin | D21/1 |
| D. 285,327 | 8/1986 | Yano | D21/147 |
| D. 297,748 | 9/1988 | Marino | D21/147 |
| D. 303,820 | 10/1989 | Wong | D21/147 |
| D. 318,309 | 7/1991 | D'Andrade | D21/147 |
| D. 336,939 | 6/1993 | Salmon et al. | D21/147 |
| D. 338,697 | 8/1993 | Salmon et al. | D21/147 |
| D. 340,750 | 10/1993 | Salmon et al. | D21/147 |
| D. 341,174 | 11/1993 | Salmon et al. | D21/147 |
| D. 341,396 | 11/1993 | Salmon et al. | D21/147 |
| 1,964,345 | 6/1934 | Feller | 225/17 |
| 2,049,194 | 7/1936 | Chapin et al. | 43/147 |
| 2,303,510 | 12/1942 | Swebilius | 42/69 |
| 2,423,220 | 7/1947 | Arpin | 222/383.1 X |
| 2,589,977 | 3/1952 | Stelzer | 222/79 |
| 3,197,070 | 7/1965 | Pearl et al. | 222/79 |
| 3,273,553 | 9/1966 | Doyle | 124/3 |
| 3,318,482 | 5/1967 | Voce | 222/79 |
| 3,578,789 | 5/1971 | Ferri | 222/79 |
| 3,794,789 | 2/1974 | Bynum | 200/83 |
| 4,022,350 | 5/1977 | Amron | 222/79 |
| 4,214,674 | 7/1980 | Jones et al. | 222/79 |
| 4,441,629 | 4/1984 | Mackal | 222/324 |
| 4,591,071 | 5/1986 | Johnson | 222/39 |
| 4,706,848 | 11/1987 | D'Andrade | 222/79 |
| 4,735,239 | 4/1988 | Salmon | 141/25 |
| 4,743,030 | 5/1988 | Auer et al. | 273/349 |
| 4,750,641 | 6/1988 | Hun | 222/79 |
| 4,757,946 | 7/1988 | Johnson | 239/99 |
| 4,854,480 | 8/1989 | Shindo | 222/79 |
| 5,029,732 | 7/1991 | Wong | 222/79 |
| 5,052,587 | 10/1991 | Graves | 222/79 |
| 5,074,437 | 12/1991 | D'Andrade | 222/79 |
| 5,150,819 | 9/1992 | Johnson et al. | 222/79 |
| 5,155,310 | 10/1992 | Goans | 200/82 |
| 5,184,755 | 2/1993 | Brovelli | 222/79 |
| 5,184,756 | 2/1993 | Amron | 222/79 |
| 5,229,531 | 7/1993 | Song | 42/58 |
| 5,238,149 | 8/1993 | Johnson et al. | 222/79 |
| 5,244,153 | 9/1993 | Kuhn et al. | 239/587.5 |
| 5,292,032 | 3/1994 | Johnson et al. | 222/79 |
| 5,322,191 | 6/1994 | Johnson et al. | 222/79 |
| 5,339,987 | 8/1994 | D'Andrade | 222/79 |
| 5,360,142 | 11/1994 | Stern et al. | 222/79 |
| 5,586,688 | 12/1996 | Johnsone et al. | 222/79 X |

*Primary Examiner*—Kenneth Bomberg
*Attorney, Agent, or Firm*—Kennedy, Davis & Kennedy

[57] ABSTRACT

A water gun (10) is provided having a storage tank (18), a pressure tank (19), and a pump (32) for conveying liquid from the storage tank to the pressure tank. The conveyance of liquid from the storage tank creates a vacuum which is controller through a control valve (43) to refill the storage tank with water in an efficient manner.

16 Claims, 4 Drawing Sheets

VACUUM ACTUATED REPLENISHING WATER GUN

TECHNICAL FIELD

This invention relates to toy water guns, and especially to water guns which are capably of drawing water to replenish a stored supply of water.

BACKGROUND OF THE INVENTION

Water guns which eject a stream of water have been a very popular toy for children. These guns have been designed to eject the stream of water in a number of ways. The most common method of ejecting water has been by a manual pump coupled to the trigger of the gun. The pump is actuated by the mere pressure exerted by one finger of an operator upon the trigger, thus the pump typically cannot generate enough pressure to eject the water a lengthy distance. Additionally, these types of pumps work on the actuation of a compression piston which creates single, short bursts of water. However, many children desire the production of an extended stream of water.

Toy water guns have also been developed which eject a stream of water by exerting pressure on the water within the gun greater than that of ambience and controlling the release of water through a control valve. The water is expelled from the gun due to this pressure difference. The pressurization of the water has been achieved in a variety of manners. U.S. Pat. No. 3,197,070 illustrates a water gun wherein pressure is applied to the water by collapsing a water storage area. Similarly, U.S. Pat. No. 4,854,480 illustrates a water gun wherein water is forced into an elastic bladder which expands to maintain the water under pressure.

Lastly, water guns have been designed with manual pumps which force water from a storage reservoir to a pressure reservoir, as shown in U.S. Pat. No. 5,150,819. The conveyance of the water into the pressure tank compresses the air therein, thereby exerting pressure on the water within the storage tank.

In all the previously described embodiments the guns include a reservoir which contains a supply of water. This reservoir typically includes a fill cap which is removed from a fill opening to allow water to be poured into the reservoir or the fill opening submerged in water to allow water to flow into the reservoir. However, with either method of filling the reservoir the process is extremely slow since these openings are usually small and the water flowing inward through the opening is hampered by the air displaced by the water flowing outward through the opening.

Accordingly, it is seen that a need remains for a water gun which can be refilled with water quickly and efficiently. It is to the provision of such therefore that the present invention is primarily directed.

SUMMARY OF THE INVENTION

In a preferred form of the invention a water gun comprises first conduit means having one end open to ambience, a reservoir coupled to the first conduit means adapted to store a supply of liquid and maintain a vacuumed environment therein, and a control valve coupled to the first conduit means positioned between the reservoir and the open end. The control valve is moveable between a closed position preventing the flow of liquid through the first conduit means and an open position allowing the flow of liquid through the first conduit means. The water gun also includes second conduit means for conveying the liquid and pump means in fluid communication with the reservoir for extracting liquid from the reservoir and depositing the liquid into the second conduit means. With this construction and with the control valve in its closed position, the actuation of the pump means causes liquid to be drawn from the reservoir thus creating a vacuum therein, thereafter the open end of the first conduit means may be submerged with a supplemental supply of liquid and the control valve actuated to its open position to allow the vacuum within the reservoir to draw at least a portion of the supplemental supply of liquid through the first conduit means and into the reservoir.

DETAILED DESCRIPTION

Figure 2:
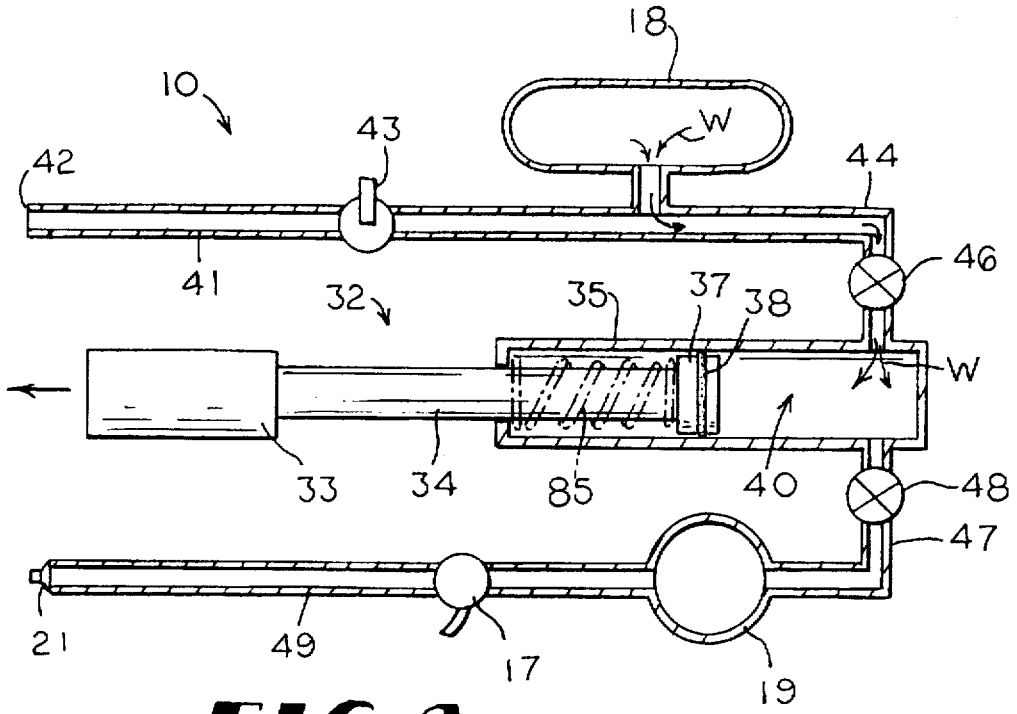
FIG. 2 is a schematic diagram of the water gun of FIG. 1, shown with the pump drawing water from the water reservoir tank.
Figure 3:
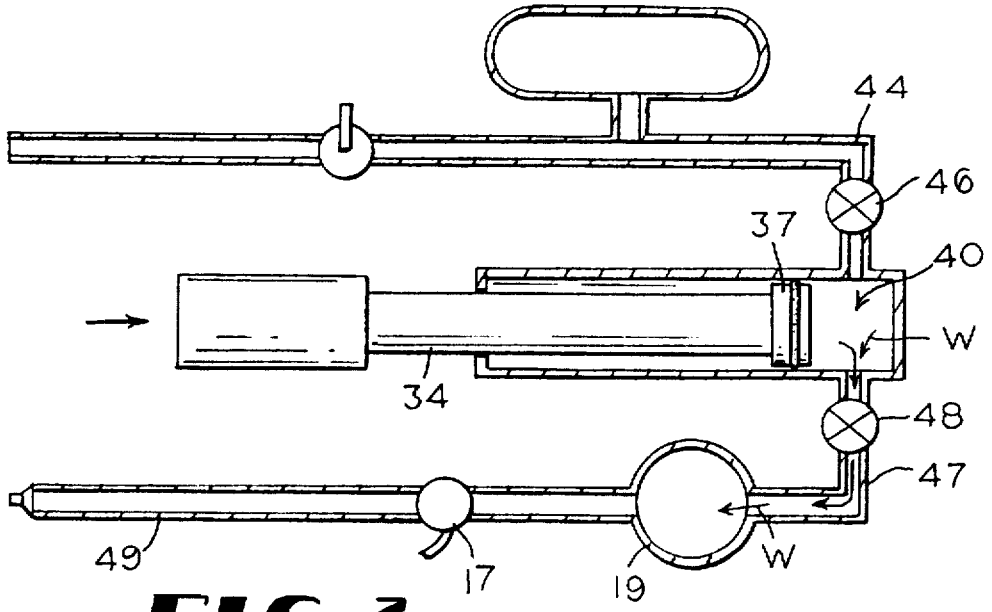
FIG. 3 is a schematic diagram of the water gun of FIG. 1, shown with the pump forcing water into the pressure tank.

With reference next to the drawings, there is shown a water gun 10 having a housing 11 in the shape of a gun with a barrel 13, a handle 14 and a stock 15. The gun 10 has a conventional trigger 17, a removable liquid storage tank or reservoir 18 coupled to the stock 15, a liquid pressure reservoir or tank 19 mounted to the stock, and a conventional nozzle 21 mounted to the end of the barrel 13. The storage tank 18 has a threaded neck 23 threadably mounted within a threaded receptor 24 within the housing and an opening or port 20 in which is removably mounted a filling cap 25. The gun 10 has a liquid pump 32 having a handle 33 slidably mounted to barrel 13. The handle 33 is coupled to a piston 34 slidably mounted within a cylinder 35, as shown in FIGS. 2 and 3. The piston has a enlarged head portion 37 having an O-ring type seal 38 in sealing contact with cylinder 35. The cylinder 35 and head portion 37 of the piston 34 define a pump chamber 40. A fill tube 41 extends from a water inlet 42 extending through nozzle 21 to the reservoir 18. A manual control valve 43 is coupled to fill tube 41 to control the flow of liquid through the fill tube. The control valve 43 is operable between a closed position preventing fluids from passing through the fill tube and an open position allowing fluids to pass through the fill tube to reservoir 18. An intake tube 44 extends from storage tank 18 to an inlet of pump 32. A check valve 46 is coupled to the intake tube 44 to prevent the flow of liquid from the pump 32 to the reservoir 18. An outlet tube 47 extends from an outlet of pump 32 to pressure tank 19. Outlet tube 44 is coupled to a check valve 48 which restricts the flow of liquid from the pressure tank 19 to the pump 32. A flexible delivery tube 49 extends from the pressure tank 19 to nozzle 21. A conventional trigger 17 is coupled to the delivery tube 49 to control the release of liquid therethrough.

In use, the liquid storage tank 18 is filled with a liquid, hereinafter referred specifically to as water W, either by removing it from the stock 15 and filling it through neck 23 or by removing filling cap 25 and pouring water into the tank through opening 20. Should the storage tank be removed for filling it is subsequently threadably remounted to the stock.

With the control valve 43 in a closed position, the pump handle 33 is then reciprocally moved so as to actuate piston 34 through cylinder 35. The movement of the piston 34 within the cylinder 35 has two-cycle strokes, a priming stroke where water is drawn forth from the storage tank 18, and a compression stroke wherein water is displaced by the piston 34. The priming stroke starts when the piston 34 is retreated within its cylinder 35 to create the elongated volume chamber 40, as shown in FIG. 2. The vacuum created by the expanding chamber 40 draws water from the reservoir 18 through the intake tube 44 and check valve 46, and into chamber 40. The flow of water into the expanding chamber 40 opens check valve 46 which is normally biased in a closed position. Removal of water from the storage tank creates a vacuum within the reservoir 18.

As shown in FIG. 3, the compression stroke created by the advancement of the piston 34 within the cylinder 35 causes the water within the chamber 40 to become pressurized. The pressure of the water opens check valve 48 which allows water to flow through outlet tube 47 and into pressure tank 19. As the piston is reciprocated within its cylinder, water is repeatedly drawn from the reservoir and deposited into the pressure tank. As more and more water is drawn and forced into the pressure tank, the air within the pressure tank displaced by the water is compressed, thereby pressurizing the water therein. This may occur until the force used to drive the piston can no longer overcome the stored pressures within the pressure tank, or the water pressure reaches a preselected pressure level which overcomes the force exerted by trigger 17 so as to allow the water to be released through delivery tube 49. It should be understood that an elastic pressure tank may be used as an alternative which does not require the compression of air therein.

To release the pressurized water from the gun the trigger 17 is manually operated to allow water to pass through delivery tube 49 so as to be released as a stream from nozzle 21. It should also be understood that the water gun may emit a stream of water while simultaneously pumping water through actuation of handle 33.

To replenish the reservoir 18 with water, the intake tube inlet 42 within the nozzle 21 is submersed in a supply of water and the control valve 43 is moved to its open position. The opening of the control valve 43 allows the vacuum within the reservoir to draw at least a portion of the water into water inlet 42, through intake tube 44, and into the reservoir 18. Once the reservoir has been refilled or the vacuum is depleted, the control valve 43 is returned to its closed position.

With reference next to FIGS. 4–7, a water gun 60 in another preferred form is shown as an alternative to that shown in FIGS. I and 2. The basic construction of the water gun 60 is similar to that previously described, except for the position of the coupling between the intake tube 44 and the pump 32, the elimination of check valve 46, and the construction of the pump piston head 34. Here, the intake tube 44 is coupled to the pump adjacent the forward portion of the pump cylinder 35 opposite the coupling position of the outlet tube 47. The pump also has a closed forward end 61 having a O-ring seal 62 in sealing contact with the shaft 63 of the pump piston 34. With this construction the chamber 40 is now segmented by the head portion 37 into a forward chamber portion 65 and a rearward chamber portion 66.

Figure 4:
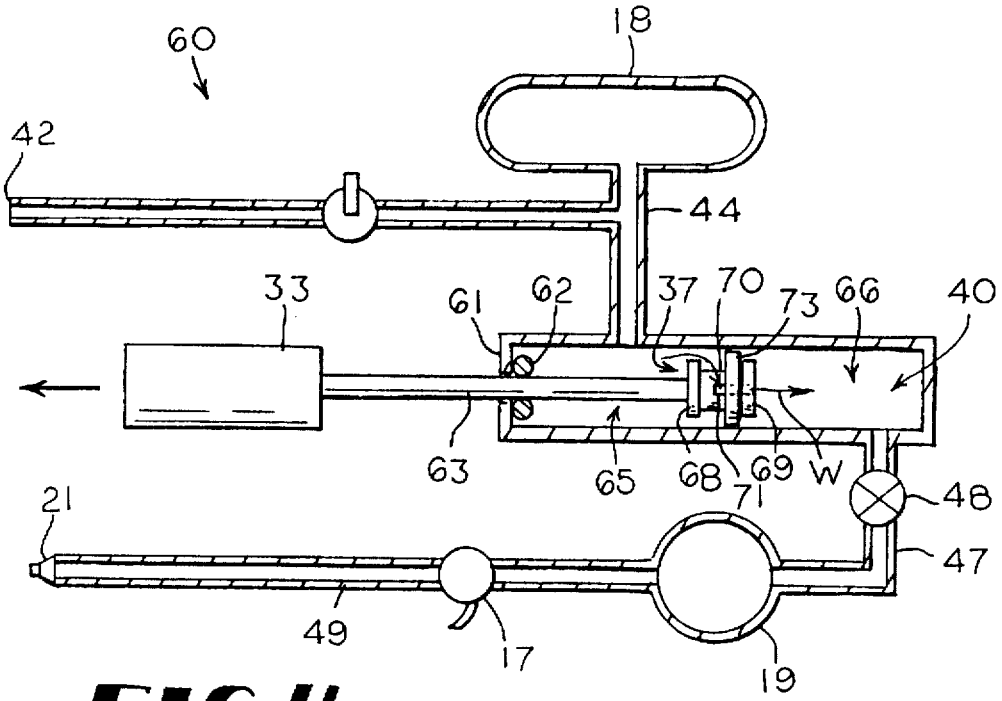
FIG. 4 is a schematic diagram of an alternative embodiment of the water gun shown in FIG. 1, shown with the pump forcing water from a forward chamber portion of the pump to a rearward chamber portion of the pump.
Figure 5:
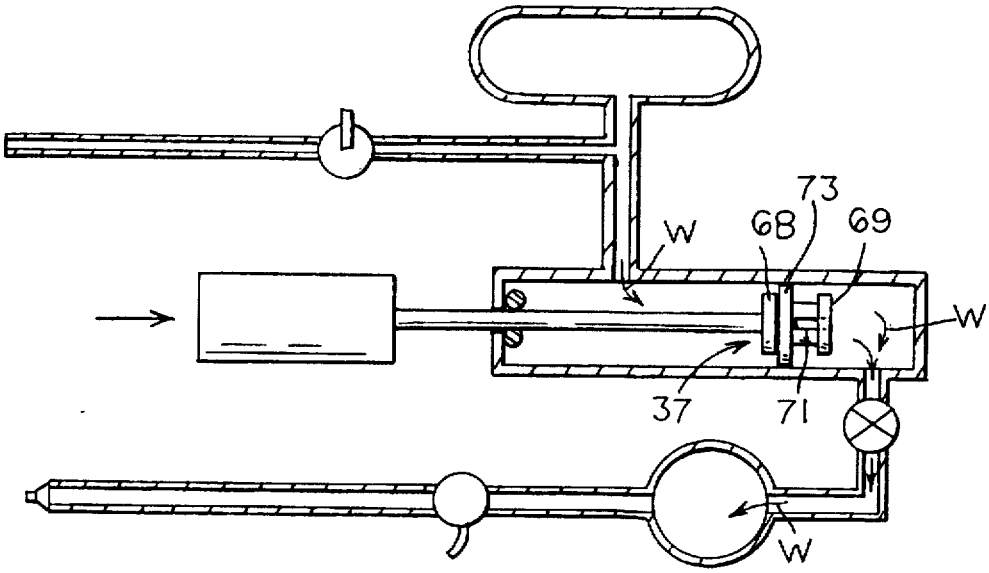
FIG. 5 is a schematic diagram of the water gun of FIG. 4, shown with the pump drawing water from the water reservoir tank and forcing water into the pressure tank.
Figure 6:
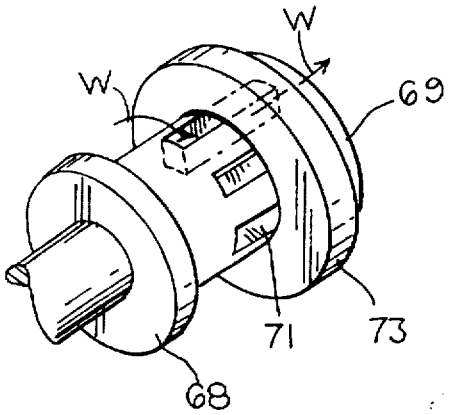
FIG. 6 is a perspective view of a portion of the pump piston of the water gun of FIG. 4, shown in a configuration to allow the passage of water therethrough.
Figure 7:
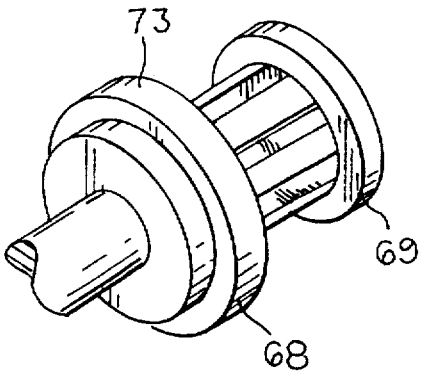
FIG. 7 is a perspective view of a portion of the pump piston of the water gun of FIG. 4, shown in a configuration to prevent the passage of water therethrough.

The piston head portion 37 has a forward flange 68, a rearward flange 69, and a generally cylindrical body 70 extending between the forward and rearward flanges. An annular array of passages 71 extend from the sidewall of the body adjacent the rearward flange 69 to the rear end of the piston head portion. A sealing ring 73 is mounted to the body 70 between the forward and rearward flanges. The sealing ring 73 is movable between an open, rearward position adjacent the rearward flange 69, as shown in FIGS. 4 and 6, which allows the flow of liquid through the piston head portion passages 71, and a sealed, forward position adjacent the forward flange 68, as shown in FIGS. 5 and 7, which prevents the flow of liquid through the piston head portion 37. Thus, the head portion generally acts as both a piston head and a check valve. It should be understood that air may also be removed from the reservoir and deposited into the pressure tank; thus, the term fluid may be used as a substitute to the term liquid as used herein.

In use, the liquid storage tank 18 is filled with a water as previously described. The water flows from the storage tank to the forward chamber portion 65 of the pump. With the control valve 43 in a closed position, the pump handle 33 is then reciprocally moved so as to actuate piston 34 through cylinder 35. Again, the movement of the piston 34 within the cylinder 35 has two-cycle strokes. Here however the priming or forward stroke, shown in FIG. 4, by forward movement of the piston causes the sealing ring 73 to move to its rearward position adjacent rearward flange 69 to allow water to flow from the forward chamber portion 65 to the rearward chamber portion 66 through passages 71.

As shown in FIG. 5, the compression stroke created by the rearward movement of the piston 34 within the cylinder 35 causes the sealing ring 73 to move to its forward position preventing water from flowing through the piston head portion. This movement of the piston causes the water within the rearward chamber portion 66 to be pressurized. The pressure of the water opens check valve 48 which allows water to flow through outlet tube 47 and into pressure tank 19. This movement also creates a vacuum within the reservoir 18 and forward chamber portion 65.

As the piston is reciprocated within its cylinder, water is repeatedly drawn from the reservoir and deposited into the pressure tank. As more and more water is drawn and forced into the pressure tank, the air within the pressure tank displaced by the water is compressed, thereby pressuring the water therein. This may occur until the force used to drive the piston can no longer overcome the stored pressures within the pressure tank, or the water pressure reaches a preselected pressure level which overcomes the biasing force exerted by trigger 17 so as to allow the water to be released through delivery tube 49.

To release the pressurized water from the gun the trigger 17 is manually operated to allow water to pass through delivery tube 49 so as to be released as a stream from nozzle 21. It should also be understood that the water gun may emit a stream of water while simultaneously pumping water through actuation of handle 33. Optionally, a check valve may be positioned between the pump and the reservoir as previously described.

To replenish the reservoir 18 with water, the intake tube inlet 42 is submersed in a supply of water and the control valve 43 is moved to its open position. The opening of the control valve causes the vacuum within the reservoir to draw at least a portion of the water into water inlet 42, through intake tube 44, and into the reservoir 18. Once the reservoir has been refilled or the vacuum depleted, the control valve is returned to its closed position.

Figure 1:
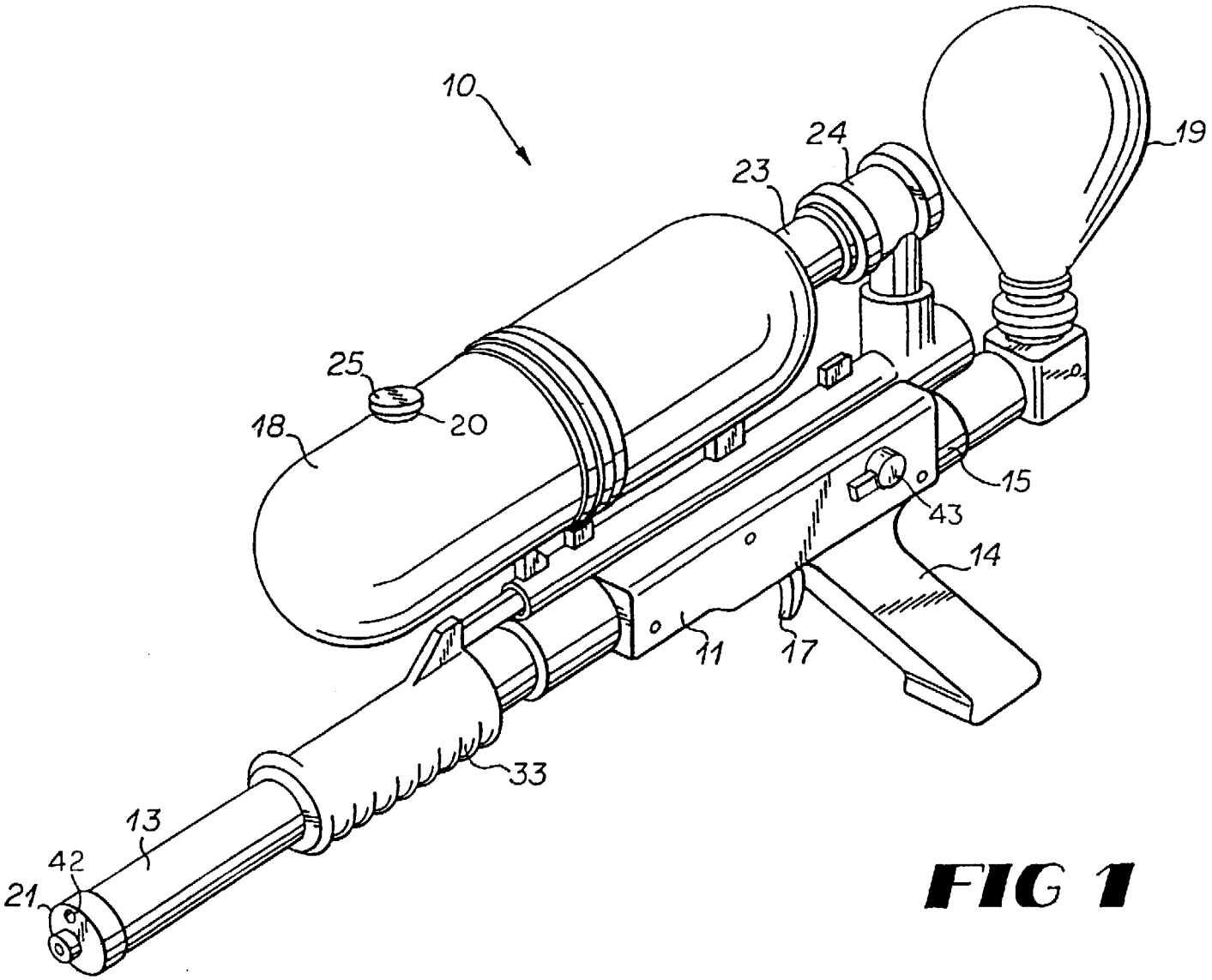
FIG. 1 is a perspective view of a water gun embodying principles of the invention is a preferred form.
Figure 8:
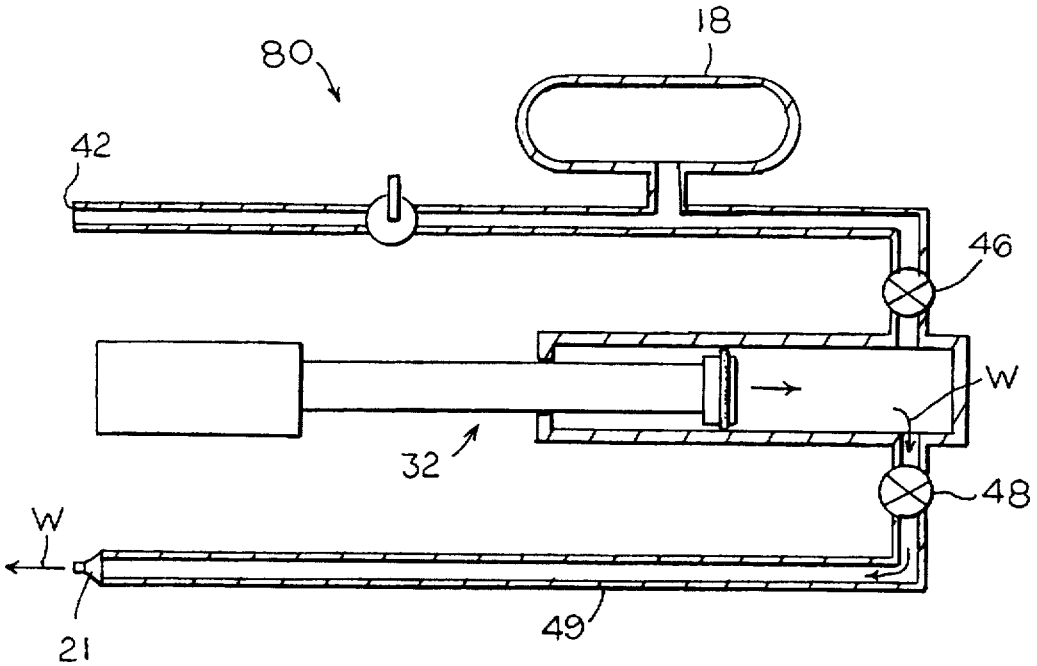
FIG. 8 is a schematic diagram of another alternative embodiment of the water gun shown in FIG. 1.

With reference next to FIG. 8, a water gun 80 in another preferred form is shown as another alternative. The basic construction of water gun 80 is similar to that described in reference to FIGS. 1 and 2, except that the pressure tank 19 and trigger 17 have been removed. It should also be understood that this embodiment could also employ the pump shown in FIGS. 4–7.

The use of this embodiment differs only in that water is not stored within a pressure tank prior to release. Here, as the compression stroke of the pump cause the water to be passed directly through the check valve 48 and delivery tube 49 and be expelled through nozzle 21. It should be understood that the actuation of the pump still causes a vacuum within the reservoir that is used to draw liquid therein at a later time.

In reference to all the previously described embodiments, the pump 32 may be provided with a coil spring 85, shown in phantom lines in FIG. 2, about the pump shaft. The spring 85 is positioned between the end of the pump cylinder 35 and the pump head portion 37. In use, the spring 85 is compressed with the priming stroke of the piston so as to place a biasing force upon the piston in the rearward direction. In the embodiments of FIGS. 1–5, the force of the spring aids to maintain a force upon the water within the pump which supplements the pressure tank with pressurized water as the pressure within the pressure tank reaches a level below the compression force of the spring as the water is released. In the embodiment of FIG. 8, a trigger is also coupled to delivery tube 49. The compression force of the spring maintains the pressure upon the water within the pump and delivery tube. As such, the pump may be extended and the trigger operated to release water. Each time the trigger is actuated the pump piston is forced rearward by the force of the spring, thus maintaining a constant force upon the water therein. It should also be understood that the compression force of the spring aids in manually moving the pump piston in a rearward direction, i.e. automatically operating the compression stroke of the pump. The trigger may be operated several times with each stroke of the piston.

It thus is seen that a toy water gun in now provided which through its actuation creates an efficient manner to replenish it with water. While this invention has been described in detail with particular references to the preferred embodiments thereof, it should be understood that many modifications, additions and deletions, in addition to those expressly recited, may be made thereto without departure from the spirit and scope of the invention as set forth in the following claims.

I claim:

1. A water gun comprising:

first conduit means having one end open to ambience;

a reservoir coupled to said first conduit means adapted to store a supply of liquid;

a manual control valve coupled to said first conduit means between said reservoir and said open end, said control valve being manually operable between a closed position preventing the flow of fluid through said first conduit means with said reservoir maintained under a static vacuum pressure state and an open position allowing the flow of liquid through said first conduit means;

second conduit means coupled to said reservoir for conveying the liquid from said reservoir; and pump means in fluid communication with said reservoir and said second conduit means for extracting liquid from said reservoir and depositing the liquid into said second conduit means;

whereby with the control valve in its closed position the actuation of the pump means causes liquid to be drawn from the reservoir creating a static vacuum therein, thereafter the open end of the first conduit means may be submerged into a supplemental supply of liquid and the control valve actuated to its open position to allow the vacuum within the reservoir to draw at least a portion of the supplemental supply of liquid through the first conduit means and into the reservoir.

2. The water gun of claim 1 further comprising check valve means operatively coupled to said second conduit means for preventing the flow of liquid from said pump means to said reservoir.

3. The water gun of claim 1 further comprising a pressure tank coupled to said second conduit means adapted to maintain a supply of liquid under pressure, check valve means for preventing liquid from flowing from said pressure tank to said pump means, and control means for controlling the flow of liquid through said second conduit means.

4. The water gun of claim 2 further comprising a pressure tank coupled to said second conduit means adapted to maintain a supply of liquid under pressure, second check valve means for preventing liquid from flowing from said pressure tank to said pump means, and control means for controlling the flow of liquid through said second conduit means.

5. The water gun of claim 1 wherein said pump means includes a cylinder and a piston manually operable for reciprocal movement within said cylinder between a priming stroke and a compression stroke.

6. The water gun of claim 5 wherein said pump means further comprises a spring having a biasing force in the direction of the compression stroke.

7. The water gun of claim 5 wherein said piston has a head portion having a check valve which allows the passage of water through said head portion as said head portion is moved in one direction and which prevents the passage of water through said head portion as said head portion moved in another direction generally opposite said one direction, and wherein said cylinder defines a pump chamber which is divided by said head portion into a first portion in fluid communication with said reservoir and a second portion in fluid communication with said second conduit means.

8. The water gun of claim 7 wherein said head portion and check valve comprises a body having a first end, a second end, a sidewall extending between said first end and said second end, and at least one passage extending between said sidewall and said second end; a seal movably mounted to said body portion in sealing contact with said pump cylinder; first stop means for stopping the movement of said seal upon said body in one direction; second stop means for stopping the movement of said seal upon said body in another direction opposite said one direction, whereby with the seal positioned adjacent said first stop means liquid is prevented from flowing through said head portion, and with the seal positioned adjacent said second stop means liquid flows through said head portion through said passage.

9. A water gun comprising a liquid reservoir;

an intake conduit coupled to said reservoir;

manual control valve means operatively associated with said intake conduit for manually controlling the static pressure of air within said reservoir through controlled replenishment of liquid into said reservoir;

pump means for drawing liquid from said reservoir, said pump means having an inlet in fluid communication with said reservoir and an outlet through which liquid is expelled; and check valve means coupled to said pump means outlet, said check valve means being adapted to allow the flow of fluids from said pump means through said outlet and to prevent the flow of fluids into said pump means through said outlet, whereby the actuation of the pump means creates a vacuum within the reservoir and the manual control valve means prevents the flow of fluids through the intake conduit and into the reservoir until it is manually opened with the intake conduit partially submerged within a supply of liquid so that the vacuum draws liquid into the reservoir.

10. The water gun of claim 9 further comprising second check valve means operatively coupled to said pump means for preventing the flow of liquid from said pump means to said reservoir.

11. The water gun of claim 9 further comprising a pressure tank in fluid communication with said pump means outlet for maintaining a supply of liquid under pressure, and release means for controlling the release of liquid from said pressure tank.

12. The water gun of claim 10 further comprising a pressure tank in fluid communication with said pump means outlet for maintaining a supply of liquid under pressure, and release means for controlling the release of liquid from said pressure tank.

13. The water gun of claim 9 wherein said pump means includes a cylinder and a piston manually operable for reciprocal movement within said cylinder between a priming stroke and a compression stroke.

14. The water gun of claim 13 wherein said pump means further comprises a spring having a biasing force in the direction of the compression stroke.

15. The water gun of claim 13 wherein said piston has a head portion having a check valve which allows the passage of water through said head portion as said head portion is moved in one direction and which prevents the passage of water through said head portion as said head portion moved in another direction generally opposite said one direction, and wherein said cylinder defines a pump chamber which is divided by said head portion into a first portion in fluid communication with said reservoir and a second portion in fluid communication with a second conduit means.

16. The water gun of claim 15 wherein said head portion and check valve comprises a body having a first end, a second end, a sidewall extending between said first end and said second end, and at least one passage extending between said sidewall and said second end; a seal movably mounted to said body portion in sealing contact with said pump cylinder; first stop means for stopping the movement of said seal upon said body in one direction; second stop means for stopping the movement of said seal upon said body in another direction opposite said one direction, whereby with the seal positioned adjacent said first stop means liquid is prevented from flowing through said head portion, and with the seal positioned adjacent said second stop means liquid flows through said head portion through said passage.

* * * * *